US009683457B2

(12) United States Patent
Misawa

(10) Patent No.: US 9,683,457 B2
(45) Date of Patent: Jun. 20, 2017

(54) STEAM TURBINE BEARING SUPPORT STRUCTURE AND STEAM TURBINE THEREOF

(71) Applicant: Kabushiki Kaisha Toshiba, Minato-Ku (JP)

(72) Inventor: Masato Misawa, Kanagawa-Ken (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 393 days.

(21) Appl. No.: 14/337,858

(22) Filed: Jul. 22, 2014

(65) Prior Publication Data

US 2014/0334919 A1 Nov. 13, 2014

Related U.S. Application Data

(63) Continuation of application No. PCT/JP2013/000205, filed on Jan. 17, 2013.

(30) Foreign Application Priority Data

Jan. 23, 2012 (JP) ..... 2012-011102

(51) Int. Cl.
*F01D 25/16* (2006.01)
*F01D 25/28* (2006.01)

(52) U.S. Cl.
CPC ..... *F01D 25/16* (2013.01); *F01D 25/162* (2013.01); *F01D 25/28* (2013.01); *F05D 2220/31* (2013.01); *F05D 2220/36* (2013.01); *F05D 2240/50* (2013.01)

(58) Field of Classification Search
CPC ..... F01D 25/162; F01D 25/28
See application file for complete search history.

(56) References Cited

U.S. PATENT DOCUMENTS 5,509,782 A * 4/1996 Streeter ..... F01D 25/28 248/676
6,702,551 B2 * 3/2004 Kikuchi ..... F01D 25/243 415/220
6,988,869 B2 * 1/2006 Haje ..... F01D 25/16 415/104
2012/0013033 A1 1/2012 Adachi et al.

FOREIGN PATENT DOCUMENTS

JP 54-99811 A 8/1979
JP 2003-278504 A 10/2003
JP 2010-223146 A 10/2010
WO WO 2012-008322 A1 1/2012

OTHER PUBLICATIONS

Extended European Search Report issued Nov. 11, 2015 in Patent Application No. 13740750.8.
International Search Report issued Apr. 16, 2013 in PCT/JP2013/000205 (with English language translation).

* cited by examiner

*Primary Examiner* — Ninh H Nguyen
(74) *Attorney, Agent, or Firm* — Oblon, McClelland, Maier & Neustadt, L.L.P.

(57) ABSTRACT

In a foundation in which both ends of a turbine rotor are arranged in the foundation and are freely rotatably supported by bearings, there are provided rectangular notches extending over a prescribed vertical depth from the top face of a wall surface on the casing side of a concrete section, having prescribed width and horizontal depth; bearing support members formed with an extension are laid in these notches; the bearings are installed on these extensions.

8 Claims, 4 Drawing Sheets

STEAM TURBINE BEARING SUPPORT STRUCTURE AND STEAM TURBINE THEREOF

CROSS REFERENCE TO RELATED APPLICATION

This is a Continuation of PCT Application No. PCT/JP2013/000205, filed on Jan. 17, 2013, which is based upon and claims the benefit of priority from the prior Japanese Patent Application No. 2012-11102, filed on Jan. 23, 2012, the entire contents of which are incorporated herein by reference.

FIELD

An embodiment of the present invention relates to a steam turbine bearing support structure and steam turbine thereof.

BACKGROUND

A steam turbine is arranged on an ordinary concrete foundation. FIG. 1 is a side cross-sectional view showing diagrammatically a steam turbine of a form in which a turbine rotor is supported by bearings that are arranged on conical portions of the casing.

The steam turbine 10 shown in FIG. 1 is a low pressure steam turbine, with a steam inlet section arranged in the middle and steam exhaust sections arranged at both sides, and comprises: foundations 14 that are formed by concrete sections 16; a casing 13 that is supported by these foundations 14; a turbine rotor 12 that is inserted in this casing 13; and bearings 15 whereby this turbine rotor 12 is freely rotatably supported at both sides and that are arranged on conical portions 13C of the lower part of the casing 13, by means of bearing support sections 15S.

A base plate 24 is arranged at the top of the concrete sections 16 of the foundations 14.

Also, moving blades 11 are provided on the turbine rotor 12, so that a turbine stage is constituted between these and stator blades (stator vanes), not shown, that are fixed to a stationary section on the side of the casing 13.

In modern steam turbines 10, the turbine rotor 12 is of large size due to the need for large capacity and high output, so, in a configuration in which the turbine rotor 12 is supported arranged on bearings 15 on conical portions 13C of the casing 13 as in FIG. 1, over the years, the casing 13 itself is deformed by the weight of the turbine rotor 12, leading to problems such as that stationary parts and rotary parts may come into contact, or vibration of the turbine rotor 12 due to difficulty in maintaining rigidity of the conical portions 13C.

In order to solve these problems, steam turbines 10 have been developed in which, as in FIG. 2, the bearings 15 are shifted to the top of the concrete sections 16 of the foundations 14, further towards the outside than the conical portions 13C, and in which the turbine rotor 12 is supported with the bearings 15 fixed on the concrete sections 16 of the foundations 14 with interposition of a base plate 24.

However, with the steam turbine 10 shown in FIG. 2, the distance between the bearings 15, 15 becomes large, since the bearings 15 are arranged outside the conical portions 13C of the casing 13. In general, it is known that increasing the distance between the bearings 15, 15 makes the turbine rotor 12 more liable to vibrate. While vibration of the turbine rotor 12 can be effectively suppressed by reducing the distance between the bearings 15, 15, if the axial length dimension of the casing 13 becomes small, the turbine performance is severely impaired, so that is not possible to reduce the distance between the foundations 14, 14 to less than a certain distance.

Furthermore, in order to improve these problems of the steam turbine 10 of the form shown in FIG. 2, inventions have also been proposed in which the distance between the bearings 15, 15 is reduced, without altering the distance between the foundations 14, 14, by embedding a plurality of rectangular plate-shaped reinforcing members, arranged next to each other in the same direction, in the perpendicular direction with respect to the top of the concrete sections 16 of the foundations 14, with their ends extending towards the turbine blades 11, the bearings 15 being supported on these extended portions. Examples are Laid-open Japanese Patent Application Number Tokkai S52-57412 (hereinafter referred to as Patent Reference 1) and, likewise, Laid-open Japanese Patent Application Number Tokkai 2003-278504 (hereinafter referred to as Patent Reference 2).

PRIOR ART REFERENCES

Patent References

[Patent Reference 1] Tokkai S 52-57412

[Patent Reference 2] Tokkai 2003-278504

However, when reinforcing members formed with an extension as in FIG. 2 are embedded in the top of the concrete sections 16 of the foundations 14, when the load of the turbine rotor 12, which is at least several tens of tons, acts on the extensions, a strong shearing stress is applied to the concrete sections 16 of the foundations 14 through the reinforcing members.

It is generally known that, although concrete has considerable strength with respect to compressive stress, it only has about 1/10 of this strength in regard to tensile stress (tension stress) or shearing stress, so, with a method of supporting the turbine rotor using embedded reinforcing members, it is difficult to make the extensions extend very far.

Furthermore, with a method in which the turbine rotor is supported by such embedded reinforcing members, when installing the casing 13 after arranging the reinforcing members in the concrete sections 16 of the foundations 14, there is a risk that the keys (metallic material) thereof may interfere with the casing. In order to avoid such interference, it is necessary either to embed the reinforcing members after installation of the casing 13, or to adopt a construction in which part of the casing 13 can be dismantled. In the former case, the casing 13 is installed after pouring the concrete of the foundations 14 for supporting the casing 13 and renewed pouring of concrete must be performed in order to embed the reinforcing members: thus there is the drawback that the number of steps is increased. In the latter case, a construction must be adopted whereby part of the casing can be dismantled, in order to avoid interference of the reinforcing members with the casing, so there is the drawback that the casing construction is complicated to that extent.

Accordingly, an object of this embodiment of the invention is to provide a steam turbine and a steam turbine bearing support structure whereby it is arranged that very little tensile stress or shearing stress acts on the foundations and wherein there is no possibility of interference with the bearing support members that support the bearings on installation of the casing.

In order to achieve the above object, in a steam turbine bearing support structure arranged to support a casing that accommodates a turbine rotor having turbine blades, provided with stator blades that constitute a turbine stage together with the turbine blades, arranged to support both ends of said turbine rotor in a freely rotatable fashion by means of bearings arranged on foundations; an embodiment of the present invention is characterized in that: said foundations are arranged on both sides of said casing; rectangular notches having prescribed width and depth in the horizontal direction are formed over a prescribed vertical depth from the flat face of the top of opposite wall surfaces; bearing support members formed with extensions facing said casing are laid with respect to said notches formed on each of said foundations; and said bearings are arranged on said extensions of said bearing support members.

DETAILED DESCRIPTION

Embodiments of the invention are described below with reference to the drawings. It should be noted that the same reference symbols are adopted for the same members throughout the drawings, in order to avoid repeated description.

Embodiment 1

Figure 1:
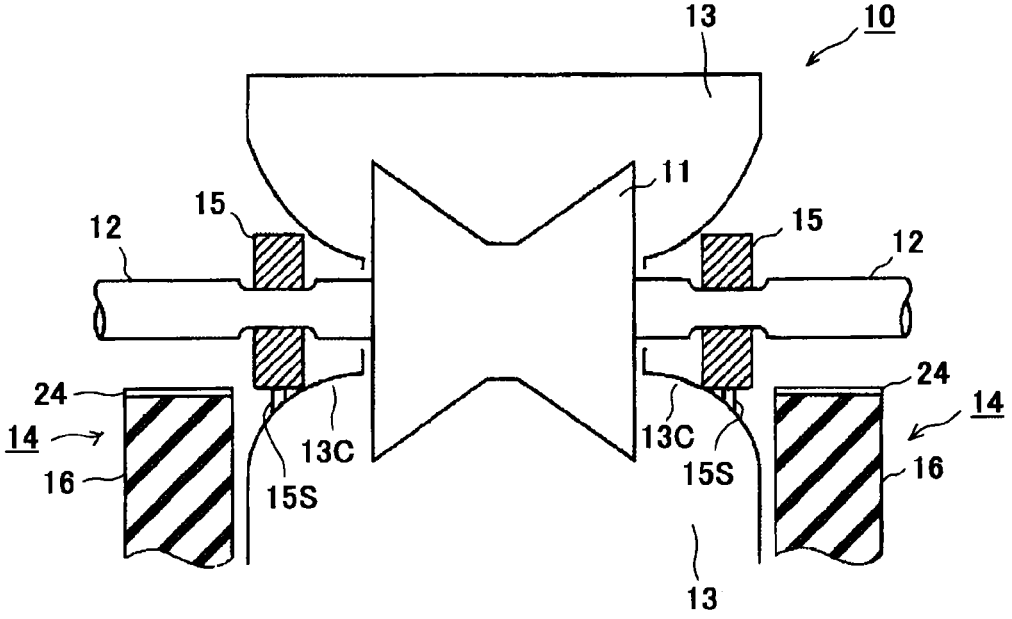
FIG. 1 is a cross-sectional view of the construction of a conventional steam turbine.
Figure 2:
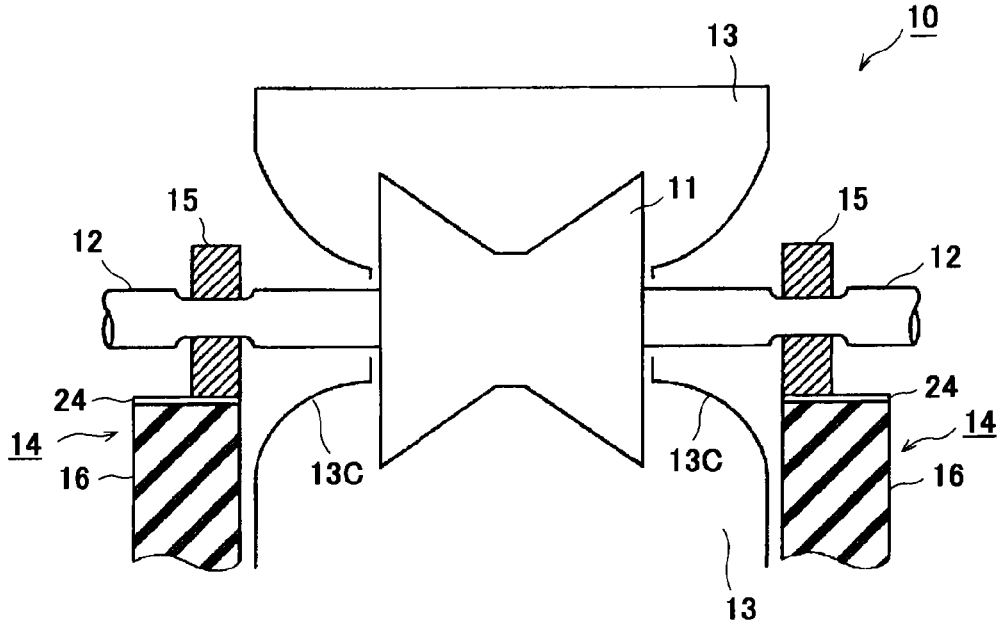
FIG. 2 is a cross-sectional view showing another construction of a conventional steam turbine.
Figure 3:
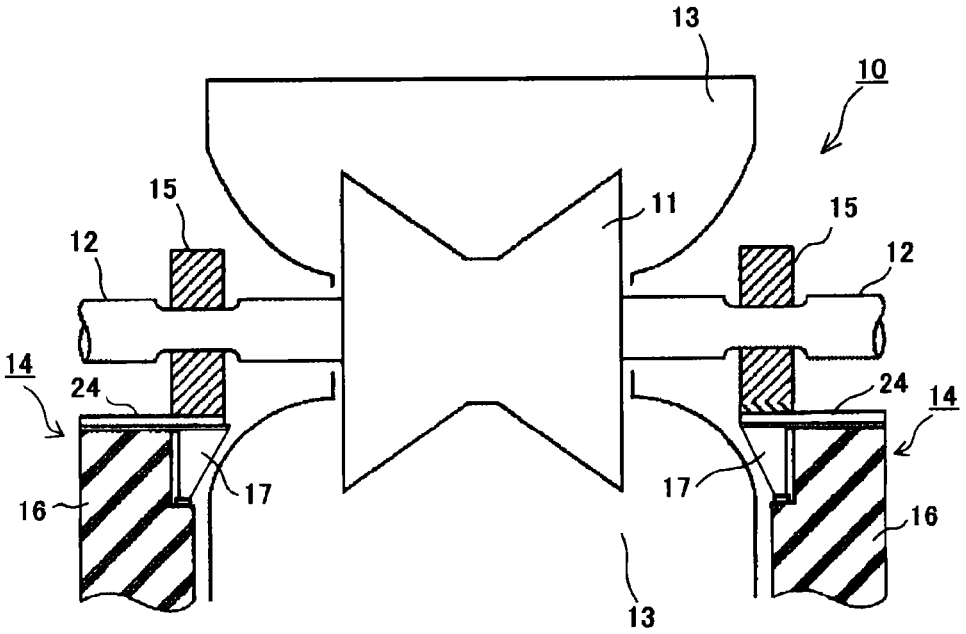
FIG. 3 is a cross-sectional view showing diagrammatically the construction of a steam turbine according to embodiment 1 of the present invention.
Figure 4:
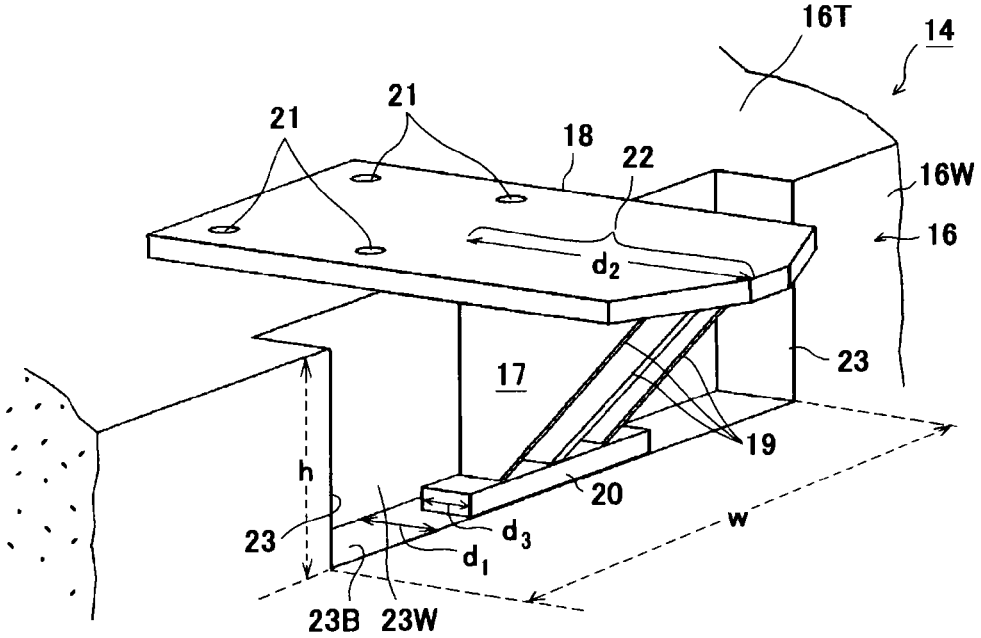
FIG. 4 is a perspective view to a larger scale showing the condition in which the bearing support member of FIG. 1 is laid on a foundation.

FIG. 3 is a diagrammatic cross-sectional view showing the construction of a steam turbine according to the present embodiment 1; FIG. 4 is a perspective view to a larger scale showing the condition in which the bearing support member of FIG. 1 is laid on a foundation; and FIG. 5 is a side view of the bearing support member of FIG. 2.

In FIG. 3, a steam turbine 10 comprises: a turbine rotor 12 in which turbine blades 11 are implanted; a casing 13 that accommodates this turbine rotor 12 and having stator blades (not shown) whereby a turbine stage is constituted between these and the turbine blades 11; foundations 14 formed of concrete reinforced by for example a steel frame; and bearings 15 whereby the turbine rotor 12 is freely rotatably supported on these foundations 14. One foundation is respectively arranged on each of the two sides of the casing 13 so that the bearing support members 17 are laid at the top of the concrete sections 16 thereof.

Figure 5:
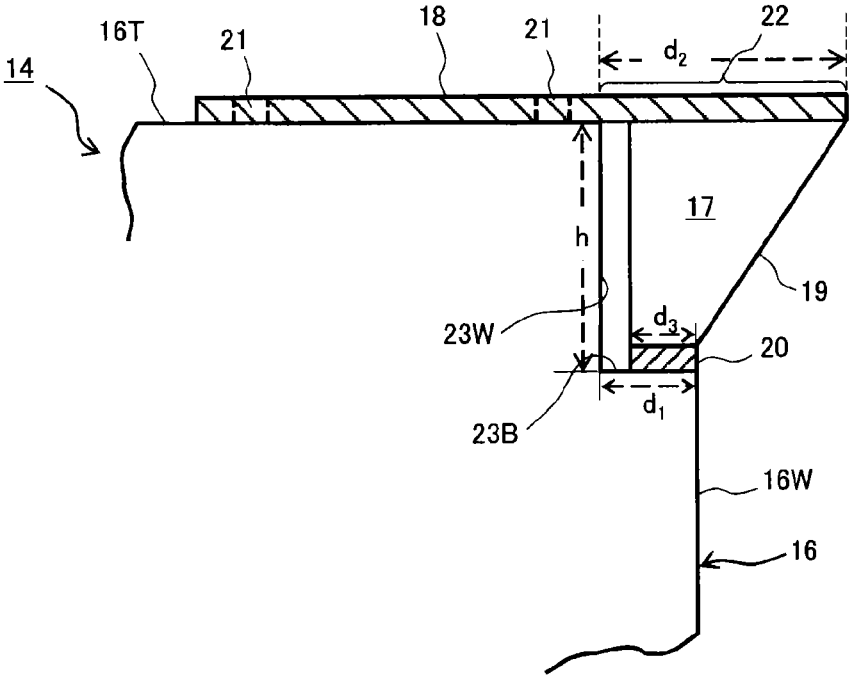
FIG. 5 is a side view of the bearing support member of FIG. 2.

As shown in FIG. 4 and FIG. 5, the concrete sections 16 of the foundations 14 have flat surfaces 16T at the top thereof and, furthermore, rectangular notches 23 having a prescribed width and depth in the horizontal direction are formed over a prescribed depth in the downwards direction with respect to the wall surface 16W facing the bottom of the casing 13, with reference to the position of the flat face 16T at the top thereof.

As will be later described, these notches 23 are provided in order to accommodate reinforcing members 19 formed in substantially rectangular triangular shape in inverted condition, and constitute a structural component of the bearing support member 17; bottom plates are fixed at the bottom of these reinforcing members 19; their vertical depth (h) from the top flat face 16T, their horizontal depth (d1) and width (w) are determined by the weight of the turbine rotor 12.

In the case of embodiment 1, the bearing support member 17 comprises three structural components. Specifically, the bearing support member 17 comprises: a flat plate shaped steel top plate 18 arranged on the top flat faces 16T of the concrete sections 16 of the foundations 14; a plurality of steel reinforcing members 19 welded to the under surface of this top plate 18 and formed in substantially right-angled inverted triangular shape, with their corners opposite the side that is joined with the under surface of the top plate 18 cut off horizontally; and a flat plate shaped steel bottom plate 20 fixed by respectively welding to the cut-off faces of this plurality of reinforcing members 19. Furthermore, one end of the top plate 18 is formed so as to extend further into the casing 13 than the projected position of the bottom plate 20.

Also, through-holes (penetration) 21 for foundation bolts are provided at four locations, for fixing this top plate 18 to the flat faces 16T at the top of the concrete sections 16, in locations on the opposite side to that of the notch 23 of the top plate 18; the bottom plate 20 is arranged on a bottom section 23B of the notch 23, in order to bear the load that acts in the perpendicular direction from the plurality of reinforcing members 19.

It should be noted that a gap is formed between the perpendicular sides of the reinforcing members 19 and the inside wall surface 23W of the notch 23. Consequently, if the horizontal depth of the bottom plate 20 is denoted by (d3), a gap of (d1−d3) is produced between the perpendicular sides of the reinforcing members 19 and the inside wall surface 23W of the notch 23. If the dimension of the portion whereby the top plate 18 extends from the edge of the flat surface 16T at the top of the concrete sections 16 towards the notch 23 is denoted by (d2), the dimensional relationship: d2>d1>d3 holds.

In accordance with the above dimensional relationship, the bearing support member 17 is formed with an extension 22 that extends by the amount of the dimensional difference (d2−d1) from the flat face 16T of the foundation 14 towards the casing 13, past the notch 23. The bearings 15 are arranged on this extension 22, by means of the base plate 24, as shown in FIG. 3.

By supporting the turbine rotor 12 in a rotatable fashion on the bearings 15 that are arranged on the extension 22, compared with the prior art example of FIG. 2 described above, the gap between the supports of the turbine rotor 12 can be reduced: in this way, vibration of the turbine rotor 12 during rotation can be suppressed.

Also, although, in this embodiment 1, the bearing support member 17 is subjected to a moment about the bottom plate 20 of the bottom section 23B by the load acting on the bearings 15, since through-holes 21 are provided in the top plates 18 of the bearing support members 17 and fixing is effected by passing foundation bolts (not shown) through these through-holes 21, this moment can easily be withstood.

In this embodiment 1, the load of the turbine rotor 12 acting on the extension 22 of the top plate 18 acts in the perpendicular direction on the bottom section 23B of the notch 23 of the foundation 14, through the reinforcing members 19 and the bottom plate 20, but damage to the concrete is unlikely to occur, owing to the considerable strength possessed by the concrete section 16 constituting the foundations 14 with respect to force in the compressive direction. The advantage is therefore achieved that the bearings can be held in a stable fashion, notwithstanding vibration of the turbine rotor, over a long period of power plant operation.

Also, in this embodiment 1, since the bearing support members 17 are laid in the notches 23 formed in the top of the foundations 14, rather than embedding the bearing support members 17 in the top thereof, there is the advantage that, even if the bearing support members 17 are laid in the foundations 14 after installation of the casing 13, interference of the bearing support members and the casing 13 during such installation cannot occur.

It should be noted that, although embodiment 1 was described based on a "downward exhaust type steam turbine", in which the steam is discharged perpendicularly downwards after performing work by rotating the steam turbine 10, there is no restriction to this and the construction of this embodiment could also be applied to a "sideways exhaust type steam turbine", in which the direction of discharge of the steam is a direction orthogonal to the plane of the drawing.

Embodiment 2

Embodiment 2 will now be described with reference to FIG. 6.

Figure 6:
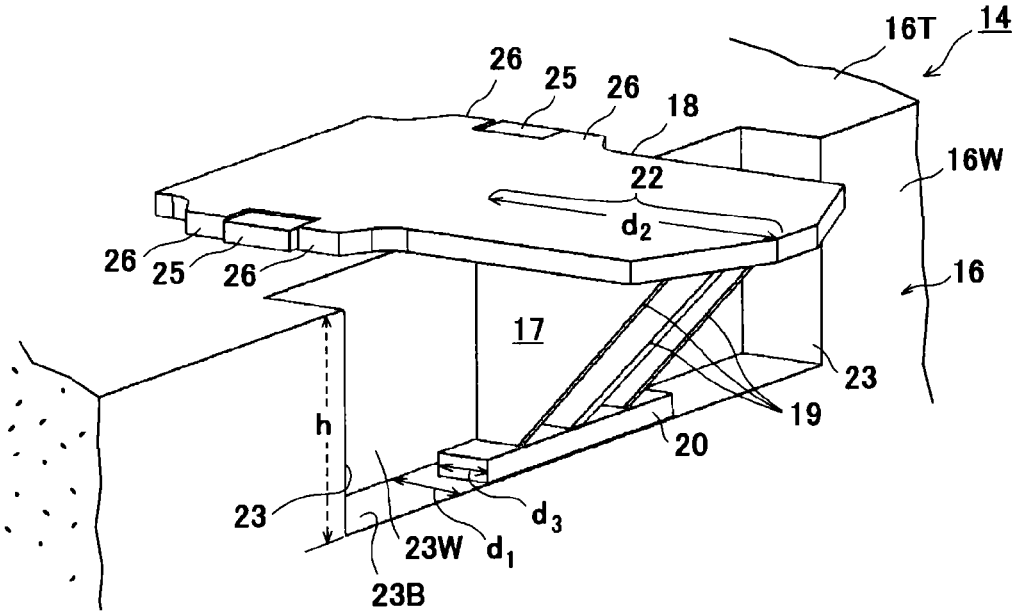
FIG. 6 is a perspective view to a larger scale showing the condition in which a bearing support member according to embodiment 2 of the present invention is laid on a foundation.

FIG. 6 is a perspective view showing the condition in which the bearing support members are laid on the foundations in embodiment 2.

In FIG. 6, items or locations that are the same as in the case of FIG. 3 to FIG. 5 are given corresponding reference symbols, to avoid repetition of description.

In embodiment 1 described above, through-holes 21 were provided in the top plate 18 in order to fix and hold the top plate 18 of the bearing support members 17 in the foundations 14, and foundation bolts, not shown, were passed through these through-holes 21. However, in embodiment 2, as shown in FIG. 6, a plurality of rectangular block-shaped keys 25 are embedded by a prescribed vertical depth in the top of the foundations 14, and the top plates 18 of the bearing support members 17 are fixed to the foundations 14 by clamping these keys 25 by means of projections 26 provided at locations on the opposite side to the extension of the top plate 18 in question.

In this embodiment 2 also, the fulcrum of the moment that acts on the bearing support members 17 is not at the top of the foundations 14 but, rather, is at the bottom plate 20 that is arranged on the bottom section 23B of the notch 23: the load applied in the perpendicular direction of the concrete sections 16 of the foundations 14 is therefore the same as in the case of embodiment 1.

Consequently, just as in the case of embodiment 1, no excessive force acts on the concrete sections 16 of the foundations 14 in the horizontal direction, so the long-term reliability of the concrete foundations is increased and the beneficial effect is obtained that it becomes unnecessary to excessively increase the strength of the concrete sections 16 of the foundations 14.

It should be noted that, in this embodiment 2, in addition to the beneficial effects described above, reduction in the amount of work to be performed can be achieved, since the additional benefit can be obtained that it is unnecessary to pass bolts into the foundation 14.

Embodiment 3

Embodiment 3 will be described below with reference to FIG. 7.

Figure 7:
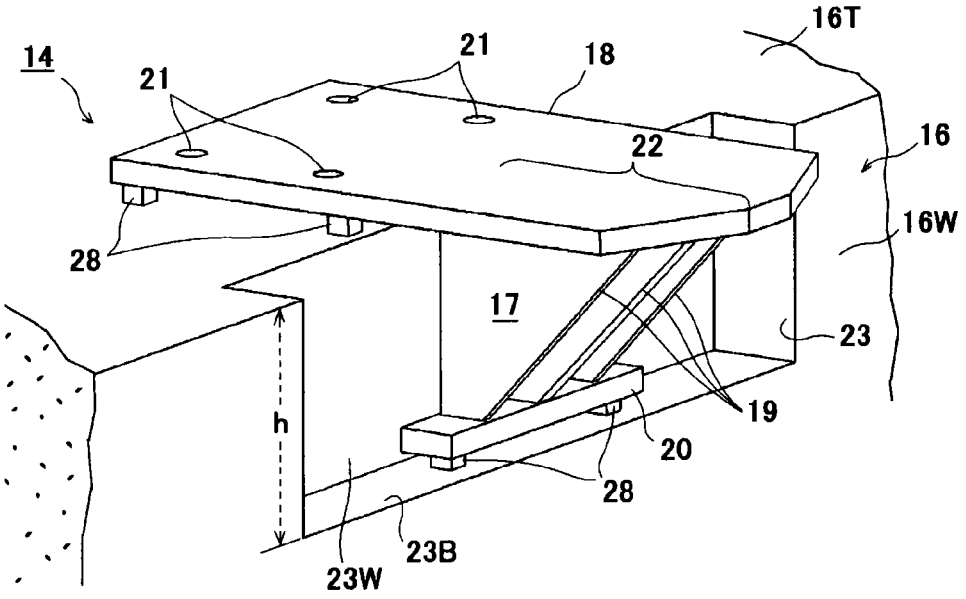
FIG. 7 is a perspective view to a larger scale showing the condition in which a bearing support member according to embodiment 3 of the present invention is laid on foundation.

FIG. 7 is a perspective view to a larger scale showing the condition in which the bearing support members of embodiment 3 are laid on the foundations.

Components or locations in FIG. 7 that are the same as in FIG. 3 to FIG. 6 are given corresponding reference symbols, to avoid repetition of description.

In embodiment 3, it is arranged to adjust the horizontal position of the top plate 18 of the bearing support members 17 in embodiment 1 described above.

In this embodiment, respective leveling blocks 28 are arranged on the flat face 16T at the top of the concrete sections 16 of the foundations 14 and on the bottom section 23B of the notch 23, so the top plate 18 can be adjusted horizontally, or adjusted to the correct angle, by arranging the top plate 18 and bottom plate 20 on respective leveling blocks 28 and performing height adjustment of the leveling blocks 28.

The bearings 15 are arranged by means of a base plate 24 after adjustment of the height of the top plate 18 by means of the leveling blocks 28. Grout (not shown) is then introduced and solidified respectively between the top plate 18 and the flat face 16T of the concrete sections 16 of the foundations 14 and between the bottom plate 20 and the bottom section 23B of the notch 23.

By means of this construction, the turbine rotor 12 is adjusted to an appropriate height, so bending of the coupling (not shown) of the turbine rotor is suppressed, preventing excessive stress being applied to the bolts of the turbine rotor coupling, and thus making it possible to suppress serious accidents due to breakage of the coupling bolts.

Also, although, when, as in the prior art, the bearing support members 17 are embedded at the top of the concrete sections 16 of the foundations 14, the height thereof cannot be adjusted after installation, with the present embodiment 3, since the bearing support members 17 are laid at the top of the foundations 14, it becomes possible to arrange leveling blocks 28 between the concrete sections 16 and the bearing support members 17, and it is therefore possible to adjust the height of the bearing support members 17.

Embodiment 4

Embodiment 4 will now be described with reference to FIG. 8.

Figure 8:
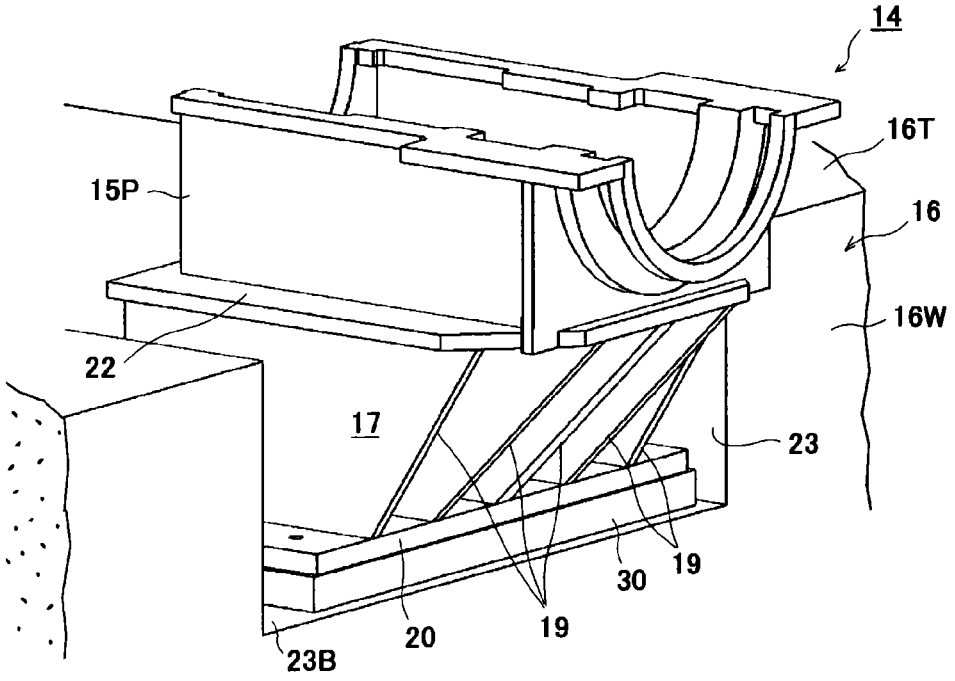
FIG. 8 is a perspective view to a larger scale showing the condition in which a bearing support member according to embodiment 4 of the present invention is laid on a foundation.

FIG. 8 is a perspective view to a larger scale showing the condition in which bearing support members according to embodiment 4 are laid on the foundations.

In FIG. 8, components or locations that are the same as in the case of FIG. 3 to FIG. 7 are given corresponding reference symbols to avoid repetition of description.

Embodiment 4 is characterized in that the bearing support members 17 are integrated with a bearing stand 15P.

In embodiment 4, a soleplate 30 is laid on the bottom section 23B of the notch 23 provided in the concrete sections 16 of the foundations 14, and a bearing stand 15P integrated with the bearing support members 17 is installed thereon. The bearing stand 15P supports the bearings 15 and is integrally fixed to an extension 22 of the bearing support members 17. The bottom plate 20 is arranged below the extension 22, with interposition of the reinforcing members 19, so that the bearing load is supported by this bottom plate 20.

With embodiment 4, the period required for the installation work can be shortened, since the base plate 24 becomes unnecessary owing to the integration of the bearing support member 17 and the bearing stand 15P, and, in addition, the fact that the step of laying the bearing support members 17 and the step of bearing installation become concurrent.

Modifications

Adjustment of the height of the top plate 18 by means of leveling blocks 28 can be implemented not merely in the case of embodiment 3 of FIG. 7 but also in the case of embodiment 2 of FIG. 6 and embodiment 4 of FIG. 8. It should be noted that, in embodiment 4 of FIG. 8, the leveling blocks 28 are disposed between the soleplate 30 and the bottom plate 20.

Beneficial Effects Common to the Embodiments

As described above, with these embodiments, since the bearings that support the turbine rotor on both sides are provided in wall surfaces facing the casing of the foundation, and bearing support members having an extension are installed in a rectangular notch of prescribed vertical depth from the flat face of the top thereof, the bearings being arranged on this extension, although the bearing support members receive a moment about the bottom plate of the bottom section of the notch, due to the load acting on the bearings, since the top plate of the bearing support members is fixed to the top of the foundation by foundation bolts or keys, it is entirely capable of withstanding this moment. Also, the gap between the bearings can be shortened.

It should be noted that the embodiments described above are presented as respective examples and are not intended to restrict the scope of the invention. Also, these embodiments could be put into practice in various other modes and various omissions, substitutions or alterations could be performed without departing from the gist of the invention. Such embodiments or modifications are included in the scope or gist of the invention and are included in the invention set out in the patent claims and equivalents thereof.

FIELD OF INDUSTRIAL APPLICATION

The present invention is utilized in regard to steam turbines.

What is claimed is:

1. A steam turbine bearing support structure, arranged to support a casing that accommodates a turbine rotor having turbine blades, provided with stator blades that constitute a turbine stage together with the turbine blades, arranged to support both ends of said turbine rotor in a freely rotatable fashion by bearings arranged on foundations, wherein said foundations are arranged on both sides of said casing;

rectangular notches having prescribed width and depth in a horizontal direction are formed in each of said foundations over a prescribed vertical depth from a flat face of a top of opposite wall surfaces;

each of the rectangular notches has a bottom section;

bearing support members formed with an extension facing said casing are laid with respect to said notches formed on each of said foundations;

each of the bearing support members includes a bottom plate, the bottom plate being supported by the bottom section of each of the rectangular notches, wherein each of said bearing support members further includes a top plate arranged on a top face of said foundations and a reinforcing member in an inverted condition connecting said top plate and bottom plate, and wherein said top plate of said bearing support member on an opposite side from that of said extension is fixed to the top face of said foundation; and said bearings are arranged on said extensions of said bearing support member.

2. The steam turbine bearing support structure according to claim 1, wherein said bearing support member comprises:

a top plate arranged at a top face of said foundations;

a bottom plate arranged at a bottom section of said notch; and a substantially right-angled triangular shaped reinforcing member in an inverted condition connecting said top plate and bottom plate.

3. The steam turbine bearing support structure according to claim 2, wherein a portion of said top plate of said bearing support member on an opposite side from that of said extension is fixed to the top face of said foundation by foundation bolts.

4. The steam turbine bearing support structure according to claim 2, wherein an embedded key that is embedded at a prescribed position of the top face of said foundation is fixed by a projection formed in a portion of said top plate on an opposite side to that of said extension.

5. The steam turbine bearing support structure according to claim 2, wherein respective leveling blocks are arranged between the top face of said foundation and the top plate of said bearing support member and between the bottom section of said notch and the bottom plate of said bearing support member, and a horizontal angle of said top plate is adjusted by adjusting a height of leveling blocks.

6. The steam turbine bearing support structure according to claim 5, wherein, after horizontal angular adjustment performed using said leveling blocks, grout is respectively introduced and solidified between the top face of said foundation and the top plate of said bearing support member and between the bottom section of said notch and the bottom plate of said bearing support member.

7. The steam turbine bearing support structure according to claim 1, wherein said top plate of said bearing support member and a bearing stand are integrally constituted and said bearing support member with the bearing stand are arranged on said foundation.

8. A steam turbine comprising a steam turbine bearing support structure according to claim 1.

* * * * *